United States Patent [19]

Legrand

[11] 4,290,652

[45] Sep. 22, 1981

[54] MACHINE FOR THE CUTTING OF ROCKS IN UNDERGROUND WORKS

[76] Inventor: Marie G. J. Legrand, Minderbroedersstraat 28, B - 3550 Heusden-Zolder, Belgium

[21] Appl. No.: 136,407

[22] Filed: Apr. 1, 1980

[30] Foreign Application Priority Data

Apr. 13, 1979 [BE] Belgium ..... 27726

[51] Int. Cl.[3] ..... E21C 27/24

[52] U.S. Cl. ..... 299/45; 299/53

[58] Field of Search ..... 299/43, 45, 53, 54, 299/46, 44, 42

[56] References Cited

U.S. PATENT DOCUMENTS 3,306,663 2/1967 Webster ..... 299/56

FOREIGN PATENT DOCUMENTS 2731586 1/1979 Fed. Rep. of Germany ..... 299/46
2809723 9/1979 Fed. Rep. of Germany ..... 299/43
1403821 8/1972 United Kingdom ..... 299/43

*Primary Examiner*—Ernest R. Purser
*Attorney, Agent, or Firm*—Stevens, Davis, Miller & Mosher

[57] ABSTRACT

The machine for the cutting of rocks in underground works comprises a slide way, a carriage on said slide way, a machine frame which is hinged relative to the carriage, an arm which is hinged relative to the machine frame, and a cutting drum mounted relative to said arm. The dimensions of the cutting drum, the arm, the machine frame and the carriage as well as the swinging motions imparted to the machine frame and to the arm are so designed that the single cutting drum can work the machine free at both ends of the slide way.

15 Claims, 11 Drawing Figures

MACHINE FOR THE CUTTING OF ROCKS IN UNDERGROUND WORKS

BACKGROUND

This invention relates to a machine for the cutting of rocks in underground works, which comprises:

a slide way, a carriage on said slide way, means to move said carriage on the slide way, a machine frame which is hinged relative to the carriage about a first axis at right angle to the lengthwise direction along which said slide way extends, means imparting to the machine frame a swinging motion about said first axis relative to the carriage, an arm which is hinged relative to the machine frame about a second axis in parallel relationship with the first axis, means to impart to said arm a swinging motion about said second axis relative to the machine frame, a cutting drum mounted relative to said arm, which drum rotates about a drum axis in parallel relationship with said first axis and second axis, and means to rotate the cutting drum about the drum axis.

In the known machines of this kind, the cutting drum can only work on one side, due to the limited angles over which the arm can be swung relative to the machine frame and said machine frame relative to the carriage. For the same reason, said known machine cannot work the complete working face in front of the machine with the carriage stationary on the slide way. Said known machine is also unsuitable for digging tunnels or galleries, notably because the cutting drum can only be brought to a limited height and not right above the carriage.

An object of the invention is to provide a machine with one cutting drum with which short working faces can be worked in mine galleries, and with which also ways, galleries and tunnels can be dug with a high height.

An object of the invention is also to provide a machine with which a gallery can be dug at the head of a cross-heading, and with which also part of the cross-heading which connects to the head gallery can be worked.

A further object of the invention is to provide a machine with which the above-described works can be performed and with which moreover the sole gallery can be cut at the bottom of the cross-heading, and simultaneously the channel for a distributing conveyor can be dug in the wall.

Still another object of the invention is to provide a machine which allows as single machine therefor to dig the head gallery, to cut the cross-heading and to dig the sole gallery, in such a way that the total costs for the working of both galleries and the cross-heading can remain low.

Another object of the invention is to provide a machine which can be arranged together with similar machines on a single conveyor.

An object of the invention is also to provide a machine of the kind defined above which can be used for various works, for instance the digging of tunnels and galleries and for the working of cross-headings, simply by substituting a carriage to another.

THE INVENTION

For this purpose the dimensions of the cutting drum, the arm, the machine frame and the carriage as well as the swinging motions imparted to the machine frame relative to the carriage and to the arm relative to the machine frame, are so designed that the single cutting drum can be swung out at both ends of the slide way, along the lengthwise direction thereof, over such a distance that no single component projects further, in such a way that the cutting drum can work the machine free at both ends of the slide way.

In an advantageous embodiment of the invention, the carriage bears with two slippers on the slide way on the side of the cutting drum, and the carriage grips with two guides about part of the slide way on the side removed from the cutting drum and the carriage encloses between said slippers and guides, an open space which is free to receive the machine frame.

In a particular embodiment of the invention, the carriage comprises a beam which connects both slippers on the side of the cutting drum, a beam which connects both guides on the side removed from the cutting drum, and two parts which connect each a slipper on the side of the cutting drum to a guide on the side removed from the cutting drum.

In a preferred embodiment of the invention, the means to impart a swing motion about the second axis to said arm, can impart a movement over at least 360°.

In a very advantageous embodiment of the invention the means to impart to said arm a swing motion about the second axis relative to the machine frame, is comprised of a planetary drive the planetary cage of which is connected to the arm, the crown is connected to the machine frame and the sun wheel lies about the second axis and is driven by a motor mounted on the machine frame.

Preferably the means to impart to the machine frame a swinging motion relative to the carriage, is a hydraulic cylinder mounted on the side removed from the cutting drum, cylinder both parts of which are hingedly connected respectively to the machine frame and to the carriage.

Other details and advantages of the invention will stand out from the following description of two machines for cutting rocks in underground works according to the invention; this description is only given by way of non limitative example and with reference to the accompanying drawings.

THE DRAWINGS

In the various figures the same reference numerals pertain to similar elements.

DESCRIPTION OF THE PREFERRED EMBODIMENT

Figure 1:
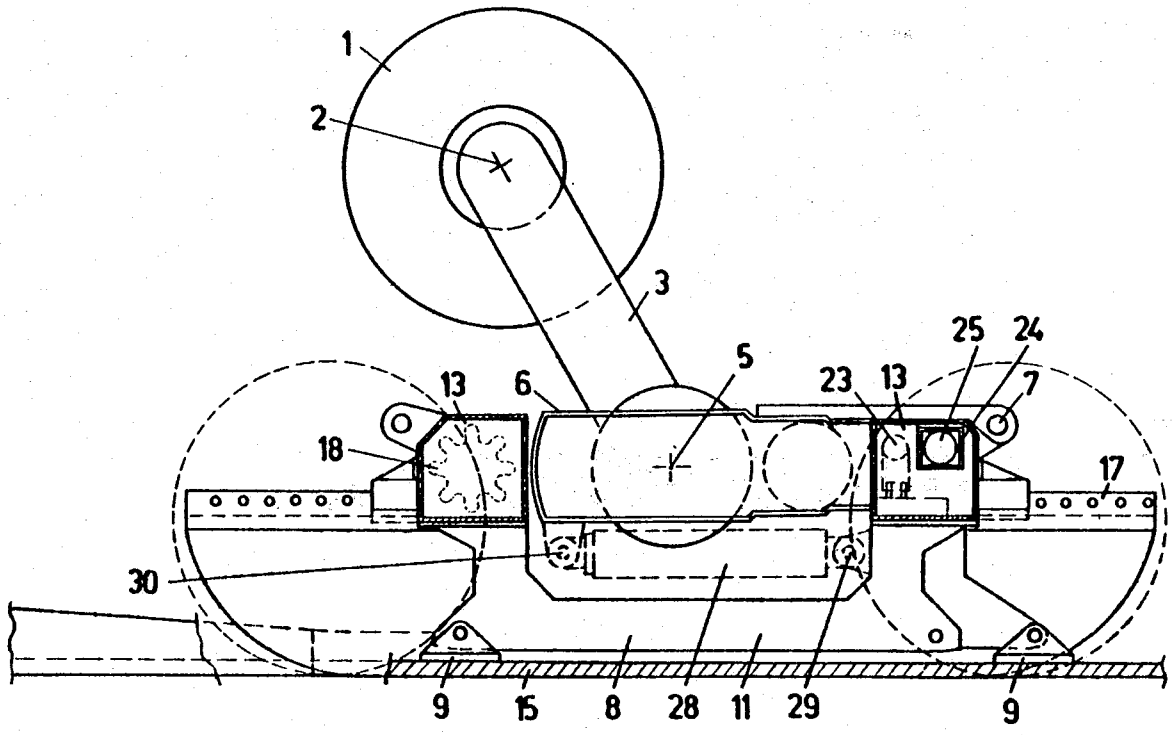
FIG. 1 is a diagrammatic cross-section through a machine for cutting rocks in underground works according to the invention.

The machine as shown in FIGS. 1 to 5 comprises a cutting drum 1 which is rotatable about an axis 2 in an arm 3.

The cutting drum 1 is driven by an electric motor 4, in a way further described hereinafter. Said arm 3 hinges about a geometrical axis 5, called hereinafter second axis. The structural embodiment of said second axis will be described below. Said axis 5 takes a fixed position relative to machine frame 6. Said machine frame 6 hinges about an axis 7, called hereinafter first axis, relative to a carriage shown generally in 8 and described in further detail hereinafter.

Said carriage 8 is mainly comprised of two slippers 9, two guides 10, a beam 11 connecting both slippers 9, a beam 12 connecting both guides 10 and two parts 13 which each connect a slipper 9 to a guide 10.

Said carriage 8 is thus frame-shaped. Said carriage has a center opening inside which the machine frame 6 can move up and down as it appears from FIGS. 1 to 4.

With said slippers 9 and guides 10 the carriage 8 bears on a slide way which is formed by the parts not shown of a conveyor.

The conveyor proper bears reference numeral 14. The fixed stringers lying in the lengthwise direction thereof are comprised of clearing plates 15 on the front side and side plates 16 on the back side.

The machine front side is that side which will face the working face, that is the side of the cutting drum 1. The back side is thus the side removed from said cutting drum 1.

The slippers 9 thus bear carriage 8 and consequently the machine on the front side. The guides 10 not only bear carriage 8 but also guide same along a rack 17 which forms the top edge of the side plates 16. The beam 12 lies above rack 17.

In that part 13 shown on the left in FIG. 1 is arranged a winch which drives a gear wheel 18. Said gear wheel 18 meshes with rack 17. The carriage 8 is pulled thereby alternately over the slide way formed by the clearing plates 15 and the side plates 16 of the conveyor framework.

Said parts 13 are L-shaped in the cross-wise direction of the conveyor. Said parts are torsion-resistant and arranged symmetrically relative to a plane at right angle to the lengthwise direction of conveyor 14. The beams 11 and 12 are flexure-resistant. Beam 11 lies partly in front of the conveyor and is built so low that the loading of the material cut by cutting drum 1 on said conveyor 14 occurs over said beam 11 and is thus hampered as little as possible.

It appears from the above that carriage 8 is actually of frame shape and that the four sides thereof comprised of beams 11 and 12 and both parts 13, surround an open space, in such a way that the cut-down material also can slide through said space to conveyor 14. The machine frame 6 can swing up and down in said same space.

In that part 13 shown on the right in FIG. 1 are arranged elements which can be slid out and which in extended position can form additional supports which support the carriage 8 outside the slide way. On the front side is arranged a leg 19 which can bear on the ground by means of a foot 20. Said leg is connected to carriage 8 by rods 21 and 22 hinged at both ends. A hydraulic cylinder 23 has a part which is hingedly connected to carriage 8 and another part which is hingedly connected to rod 22. When both parts of hydraulic cylinder 23 slide out of one another, they bring rod 22 from the position as shown in 22' to the position shown in 22. In said latter position, leg 19 supports carriage 8 on the ground outside the slide way. When both parts of hydraulic cylinder 23 are telescoped inside one another, leg 19 is pulled against carriage 8.

It is to be noted that in the retracted position, thus when leg 19 is pressed against carriage 8, said leg does not impede the movement of arm 3, in such a way that said arm 3 can be brought completely downwards next to said carriage 8.

On the machine back side is present a second leg which is mainly comprised of beam 24 and hydraulic cylinder 25. Said beam 24 can be slid in and out part 13. In extended position of beam 24, said cylinder 25 which lies normally inside said beam, can be extended. Both parts of hydraulic cylinder 25 then can slide out until foot 26 which is connected to the one part thereof, bears on the sole. When beam 24 and hydraulic cylinder 25 have taken the position shown in FIG. 2, said cylinder 25 can be adjusted relative to beam 24 with a fixed angle, by means of rod 27.

To move carriage 8 over the slide way, said rod 27 is first released, both parts of hydraulic cylinder 25 are telescoped in one another and thereafter said hydraulic cylinder is telescoped inside beam 24 and said beam 24 with cylinder 25 inside part 13.

The machine frame 6 which hinges relative to carriage 8 about axis 7, can perform relative to said carriage a swinging motion about axis 7 over an angle of about 90°. Said motion of machine frame 6 relative to carriage 8 is controlled by hydraulic cylinder 28. The one part of cylinder 28 is connected by means of the pin 29 to carriage 8; the other part of said hydraulic cylinder is connected by means of the pin 30 to machine frame 6 at the end thereof removed from axis 7. By sliding out of one another both parts of said hydraulic cylinder 28, machine frame 6 is raised relative to carriage 8. By telescoping into one another both parts of the hydraulic cylinder, said machine frame 6 is lowered relative to carriage 8.

Figure 2:
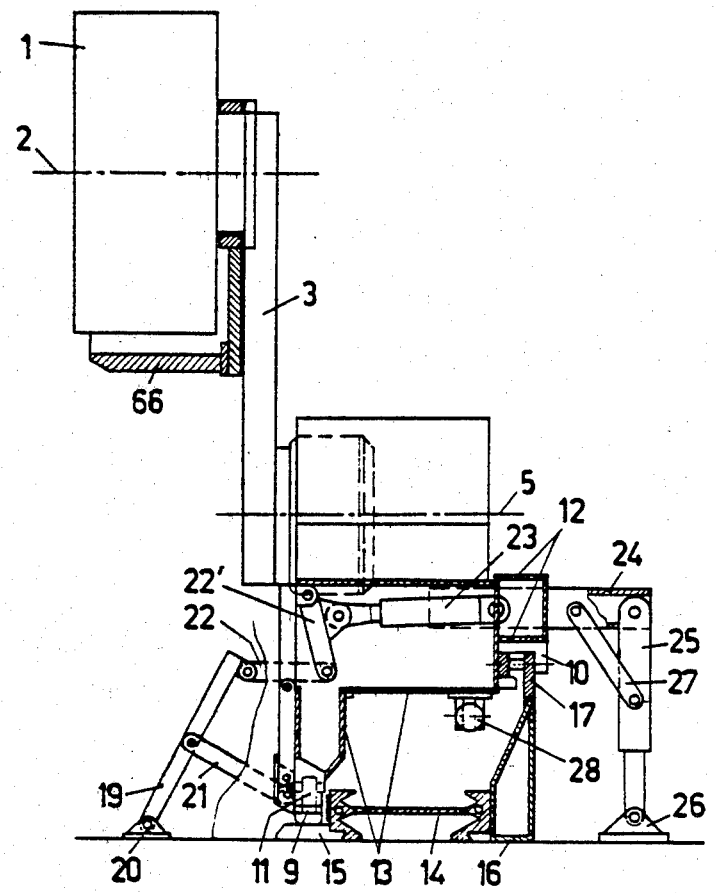
FIG. 2 is a diagrammatic side view of the machine shown in FIG. 1.
Figure 3:
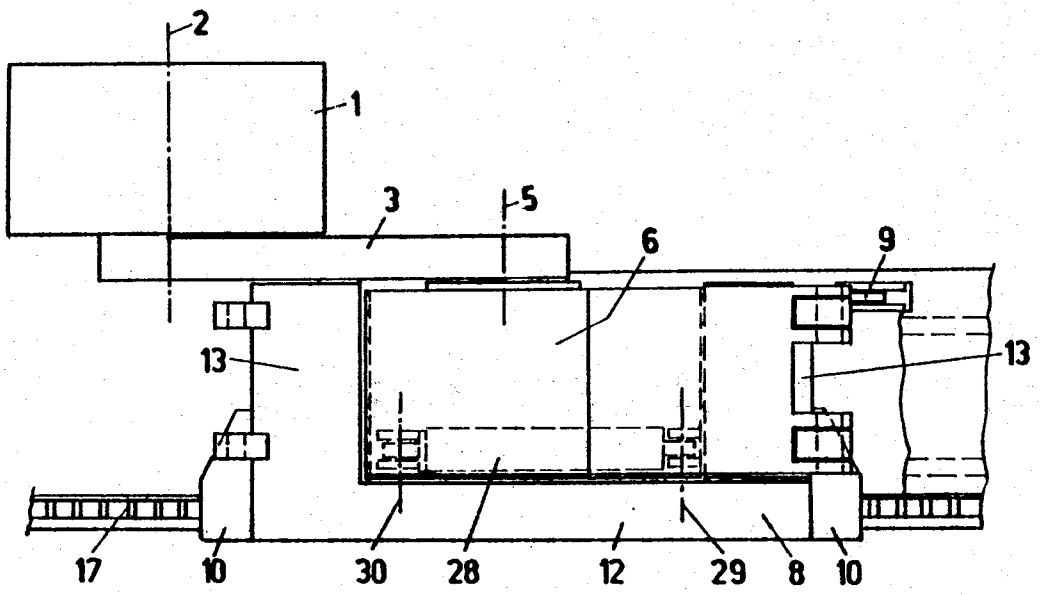
FIG. 3 is a diagrammatic top view of the machine as shown in FIGS. 1 and 2.

As it is clear from FIGS. 2 and 3, the hydraulic cylinder 28 is arranged on the back side where the discharge of the cut material towards chain conveyor 14 is hampered as little as possible.

Figure 4:
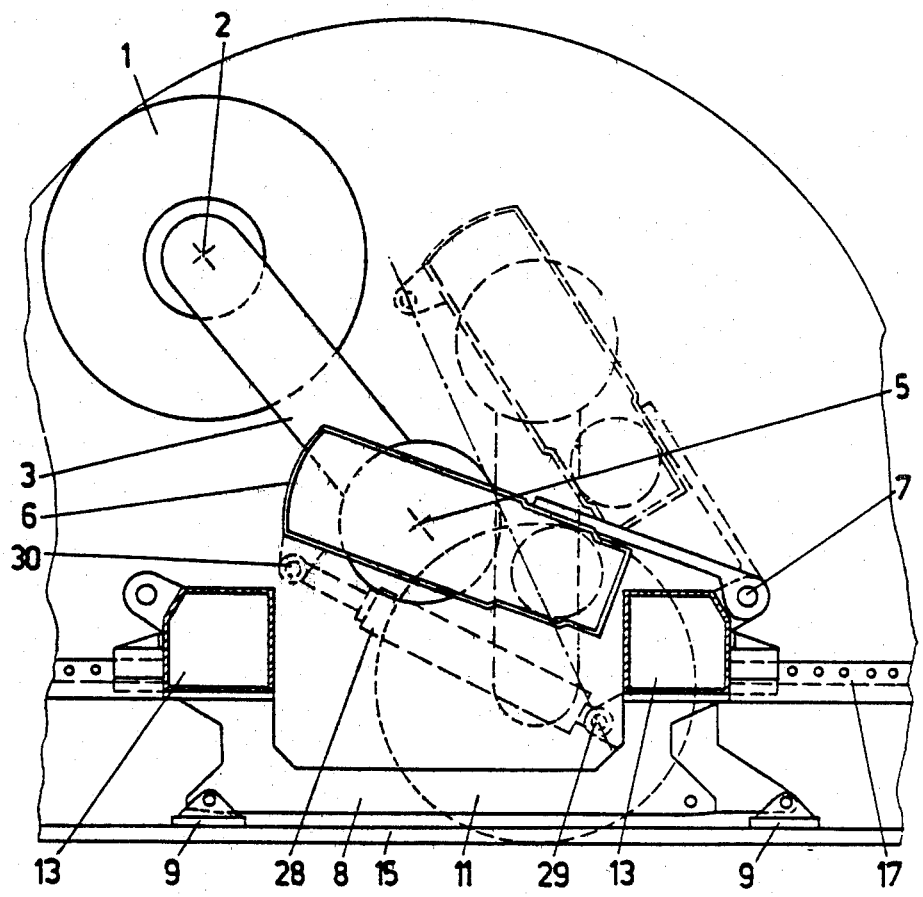
FIG. 4 is a diagrammatic cross-section similar to the one of FIG. 1, but pertaining to another position of the arm and machine frame.

In FIG. 1, said machine frame 6 is shown in the lowermost position thereof. In FIG. 4, said machine frame 6 is shown in solid line in an intermediate position and in dashed line in a higher position.

On said machine frame 6 are mounted electric motor 4 which drives cutting drum 1 and hydraulic motor 31 which controls arm 3.

The shaft 32 of electric motor 4 bears a gear wheel 33 which meshes with a gear wheel 34 which is in turn fast to a shaft 35 which is supported in machine frame 6. Said gear wheel 34 meshes in turn with a gear wheel 36 which lies on a shaft 37 which is mounted in machine frame 6. Said gear wheel 36 forms a first part of a coupling a second part of which is formed by gear wheel 38 which is alternately slidable on shaft 37. A control member not shown engages a groove 39 in part 38 of said coupling, in such a way that said part is slid alternately on shaft 37 and does engage or not part 36.

That gear wheel 38 which comprises the second part of the coupling meshes with gear wheel 40 which is fast on hollow shaft 80. Said hollow shaft 80 is coaxial with geometrical axis 5. It can rotate freely inside sleeve 51 the support of which is described hereinafter and it is also supported directly in machine frame 6 by means of roller bearings 81. Said hollow shaft 80 is also supported in planetary cage 58 described hereinafter, by means of roller bearings 61.

On that end removed from gear wheel 40, said shaft 80 bears a gear wheel 41 which drives through a gearing not shown, said cutting drum 1.

When elements 36 and 38 of the coupling engage one another, the cutting drum 1 is driven by electric motor through gear wheels 33, 34, 36, 38 and 40, shaft 80, gear wheel 41 and the gearing not shown which is mounted inside arm 3.

When parts 36 and 38 of the coupling do not engage one another, motor 4 does not drive shaft 80 and thus cutting drum 1 is not driven either.

Shaft 42 of hydraulic motor 31 bears gear wheel 43 which meshes with gear wheel 44. Said gear wheel 44 is fast to shaft 45 which also bears gear wheel 46. Said gear wheel 46 meshes with gear wheel 47 which is fast to shaft 48 which also bears gear wheel 49.

Said shafts 45 and 48 are supported in a way not shown in detail in machine frame 6. Gear wheel 46 meshes with gear wheel 50 which is fast to sleeve 51 which is supported in turn in the machine frame 6 by means of roller bearings 82.

The foremost end of sleeve 51 is provided with inner teeth 52 which mesh with outer teeth 53 from a part 54 which is actually comprised of two gear wheels from different size.

The smaller gear wheel from part 54 forms the outer teeth 53 with which the inner teeth 52 from sleeve 51 mesh. The larger gear wheel from part 54 forms the sun wheel from a planetary gearing.

With said sun wheel mesh the planetary pinions 55 which are mounted through roller bearings 56 on shafts 57 which are fast in planetary cage 58. Said planetary pinions 55 which mesh on the one side with said sun wheel which pertains to part 54, mesh on the other side with an outer crown gear 59 which is fast relative to machine frame 6.

The planetary cage 58 which is supported through roller bearings 60 in machine frame 6, is made fast to arm 3.

Figure 5:
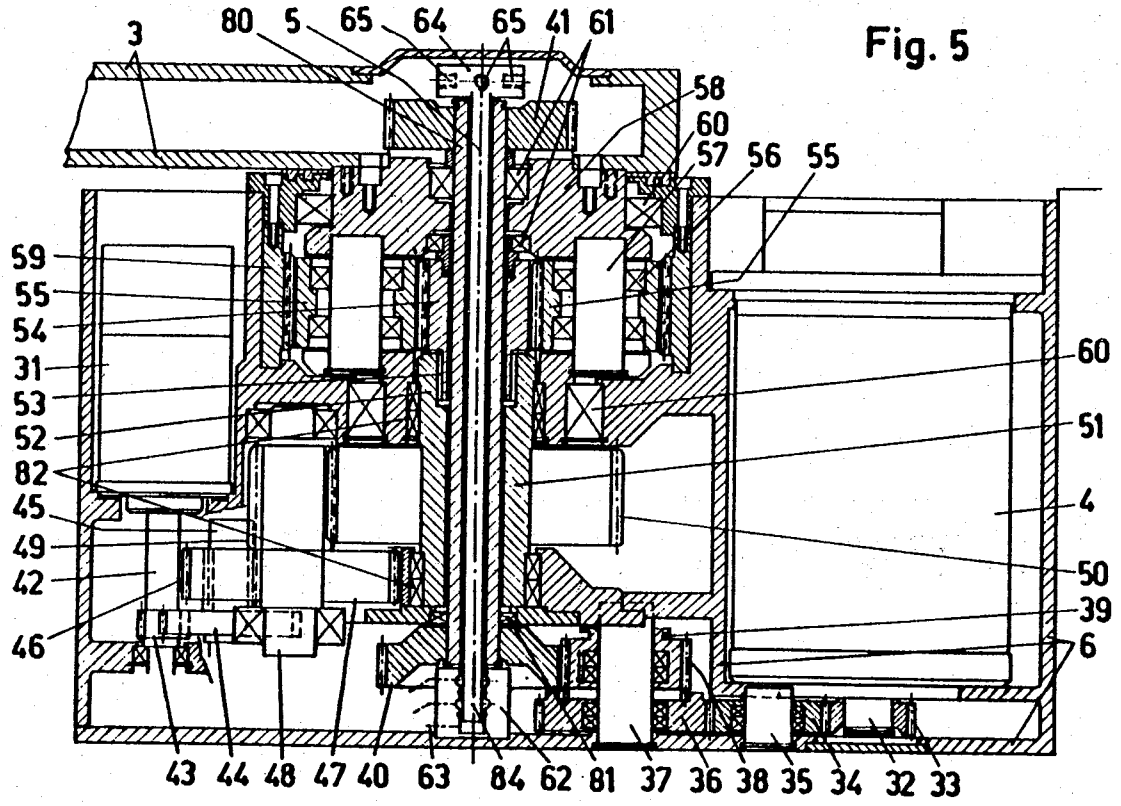
FIG. 5 is a horizontal cross-section of a mechanism which is mounted on the machine frame of the machine shown in the preceding figures.

As it appears from FIG. 5, said hollow shaft 80 which is freely rotatable inside sleeve 51, is supported in machine frame 6 through roller bearings 81 and in planetary cage 58 through roller bearings 61, said shaft thus being also freely rotatable in part 54 that is the sun wheel of the planetary gearing.

The hydraulic motor 31 drives through gear wheels 43, 44, 46, 47, 49 and 50 and the planetary gearing, said planetary cage and consequently said arm 3 connected thereto.

By means of said hydraulic motor 31 an unlimited swinging motion can be imparted to arm 3, in such a way that said arm 3 can be brought under any angle whatsoever in machine frame 6.

Through hollow shaft 80 runs a tube 84 with four ducts. Said ducts are supplied through rotating seals provided in connecting part 62.

Said connecting part 62 is fast relative to machine frame 6. Said tube moves together with arm 3. Said connecting part 62 bears three nozzles 63. Each such nozzle 63 is connected through connecting part 62 to one of said ducts which open on the other tube side in a distributing part 64 also provided with three nozzles 65. One duct and the nozzles 63 and 65 connecting thereto is used for feeding water for dust prevention at the level of cutting drum 1. Both other ducts and the nozzles 63 and 65 connecting thereto are used for feeding and returning pressurized liquid for controlling a shield 66 which hangs hingedly about drum axis, as it appears from FIG. 2.

Such an hydraulic control of a shield protecting cutting drum 1 against material is known per se and thus does not require any further description.

It is clear from the above description that the machine as shown in FIGS. 1 to 5 is mainly comprised of:

- a slide way 15, 16,
- a carriage 8 on said slide way 15, 16,
- means among which gear wheel 18, to move carriage 8 over slide way 15, 16,
- a machine frame 6 which hinges relative to carriage 8 about a first axis 7 at right angle to the lengthwise direction along which extends slide way 15, 16, that is to the face to be worked,
- means 28 to impart to machine frame 6 a swinging motion relative to carriage 8,
- an arm 3 which hinges relative to machine frame 6 about a second axis 5 which lies in parallel relationship with said first axis 7,
- means 31 to impart to arm 3 a swinging motion relative to machine frame 6, about said second axis 5,
- a cutting drum 1 mounted relative to arm 3, which rotates about a drum axis 2 in parallel relationship with said second axis 5 and first axis 7, and
- means 4 to rotate said cutting drum 1 about drum axis 2.

The sizes of drum 1, arm 3, machine frame 6 and carriage 8, and the swinging motions which are imparted to arm 3 and to machine frame 6, are so selected that said cutting drum can be arranged on either side beyond the other components of the machine and thereby can cut the machine free at both ends of the slide way 15, 16.

As considered in the direction at right angle to the working face, all of the machine components both to the left and to the right, lie within the boundary of the cutting drum 1 as said drum can be moved to the left side or to the right side. This is obtained in the best way when the spacing between the geometrical axes of the second axis 5 and the cutting drum 1 increased by the radius of the cutting drum 1, is larger than the spacing between the geometrical axes of the first axis 7 and the second axis 5. The radius of cutting drum 1 is shorter than the spacing between drum axis 2 and second geometrical axis 5.

It is to be noted that with the machine described, the cutting free can be performed on both sides by means of a single cutting drum 1, to the contrary of the case with some known machines which are provided therefor with two cutting drums.

The machine has substantial advantages some of which have already been stated above and others will be mentioned hereinafter notably as regards the described applications.

Due to the arm 3 which bears cutting drum 1 being hingedly mounted on a machine frame 6 which is hingedly mounted in turn relative to carriage 8, said cutting drum can be brought to a high height relative to the slide way and the complete machine in folded-down condition occupies but a very low height. Mostly due to this feature the same machine can be used for the digging of galleries with a high height and for working the intermediate face of low height.

The fact that the carriage 8 is also designed as a frame and leaves free an inner space whereby the cut materials can reach freely said conveyor 14, has the advantage that the cut materials are easily discharged even is the low position of machine frame 6. Arm 3 being fast to a planetary cage enhances the sturdy mounting of said arm in any position over 360°.

It is also to be noted that said slippers 9 and guides 10 with which said carriage 8 bears on slide way 15, 16 lie far away from one another but both left and right lie very close to the working cutting drum 1, which contributes to the stable arrangement of the machine.

Moreover said slippers 9 leave the drum loading area completely free.

Shaft 80 being hollow makes it easier to feed sprinkling water and to control the load shield. Said shaft 80 running through sun wheel 54 from said planetary gearing contributes to a compact and reliable driving of cutting drum 1 and makes such driving possible in any position of arm 3 by a swinging over 360°.

As it appears mostly from FIG. 4, with a suitable sliding-out of the parts from hydraulic cylinder 28, said machine frame 6 can be brought to such a position that axis 5 about which hinges arm 3 coincides with the center line of a gallery to be dug. Without further adjusting of machine frame 6 relative to carriage 8, it is possible by a simple swinging of arm 3 about axis 5 with the machine stationary, to cut-out accurately the dome of a gallery or tunnel, as regards both the height and direction.

Said machine frame 6 has been shown in dotted lines in FIG. 4 in a position whereby arm 3 together with cutting drum 1 can be swung along the bottom from the one to the other side without cutting drum 1 cutting into the gallery sole.

A machine which does not have such a feature lies within the scope of the invention but such a feature has additional advantages in the practice.

Figure 6:
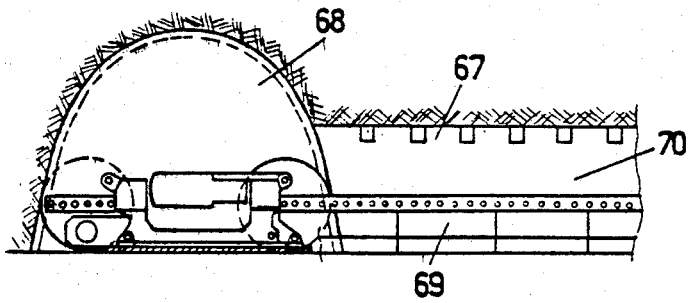
FIG. 6 is a diagrammatic showing of the machine as shown in the preceding figures, for digging a head gallery and a machine recess.

FIG. 6 shows how the above-described machine can be used for digging a machine recess or stall 67 at the head of the cross-heading and for digging a head gallery 68. The machine is slid to-and-fro over the face conveyor shown in 69, and the cut materials are loaded directly on said conveyor.

When the gallery has been cut-out at the level of the erected machine, said machine is driven in folded-down condition, that is with lowered frame 6 and lowered arm 3, in the cross-heading 70. Thereafter the conveyor 69 is advanced at the head of the cross-heading and then the following step can be cut.

Figure 7:
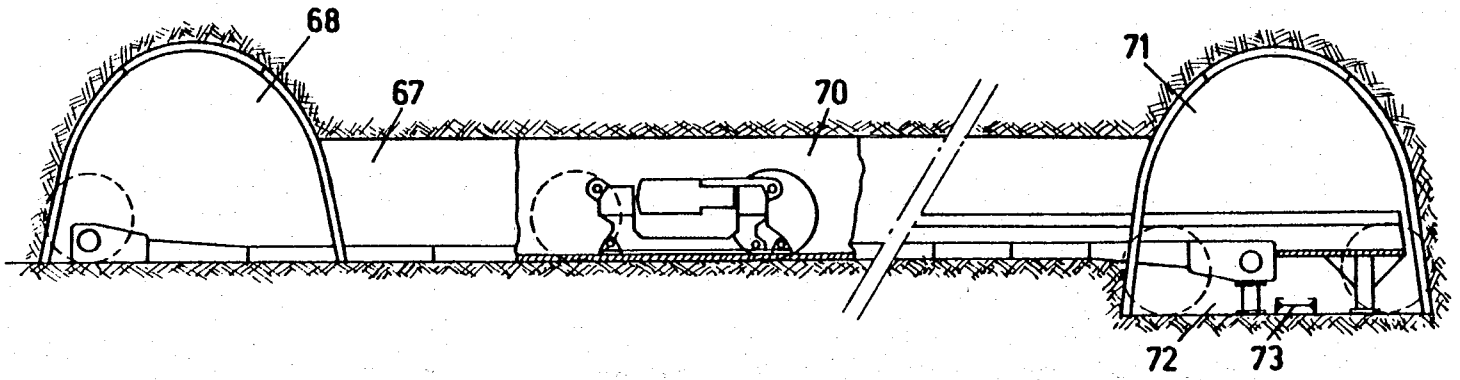
FIG. 7 is a diagrammatic showing of the machine as shown in FIGS. 1 to 5, for digging a head gallery, working a cross-heading and digging a sole gallery.

FIG. 7 shows a development of the application as shown in FIG. 6. According to this figure not only head gallery 68 and machine stall 67 are dug with the machine, but with this same machine the complete cross-heading 70 and the sole gallery 71 are worked. With the same machine the channel 72 for the distributing conveyor 73 can also be dug in the sole gallery 71.

Figure 8:
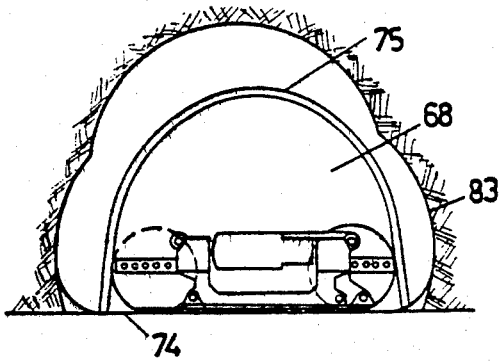
FIG. 8 is a diagrammatic showing in cross-section of an application of the machine according to FIGS. 1 to 5, for the digging of a gallery or tunnel.
Figure 9:
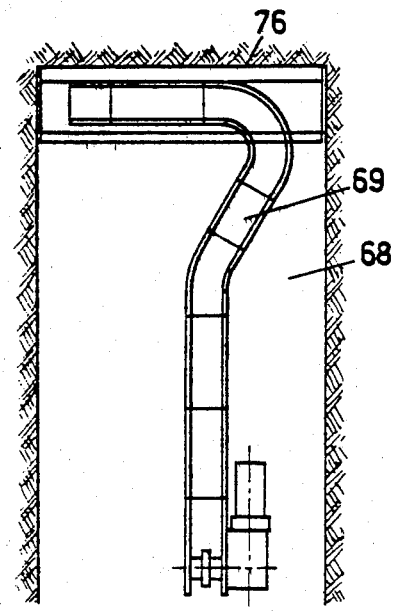
FIG. 9 is a diagrammatic top view of the application of the machine as shown in FIG. 8.

There appears from FIGS. 8 and 9 how a gallery or tunnel 68 can be dug with a machine as shown in FIGS. 1 to 5, whereby the length of the face to be worked remains limited. It is only necessary therefor to let the conveyor 69 run as shown in the top view of FIG. 9.

According to FIG. 8, the gallery has a flat sole 74 and an arcuate arch 75, but the same machine can also be used for digging tunnels with circular cross-sections.

As it appears from FIGS. 8 and 9, the machine carriage 8 can be moved in parallel relationship with the face to be worked over that portion of conveyor 69 which lies alongside said face 76.

As it appears from FIG. 9, the conveyor makes on the right-hand side of the face, a bend over 90° and then runs in parallel relationship with the lengthwise axis of gallery 68.

The cutting of the gallery dome can occur simply with a swinging of arm 3 after locating axis 5 about which said arm hinges in machine frame 6, along the center line of the arch to be formed. The machine frame 6 takes thereby the position shown in solid line in FIG. 4. To cut horizontally the gallery sole, use is made of the abovementioned feature that drum 1 together with arm 3 is movable along the machine lower side from right to left and vice versa when machine frame 6 has taken the highest position thereof which is shown in dashed line in FIG. 4.

The operation is as follows. When cutting drum 1 has been located in the lower right corner, the machine is advanced together with the conveyor on the left-hand side over a distance. The drum is brought over the sole to the left corner. Thereafter the machine is advanced together with the conveyor over a distance on the right-hand side. The drum is thereafter brought together with arm 3 along the top side to the right-hand side, whereby the desired dome shape is followed as accurately as possible. Said operations are repeated a few times, always insuring that by the movement of drum 1 at the bottom, said drum performs a horizontal traverse. The face core which is not cut during these operations, is worked thereafter by letting said carriage 8 move to-and-fro over slide way 15, 16 and thereby bringing by means of machine frame 6 and arm 3, said drum 1 to the height where material should be cut-out.

In FIG. 8 is shown the limitation of the largest surface area which can be cut by the machine, as indicated by reference numeral 83.

Figure 10:
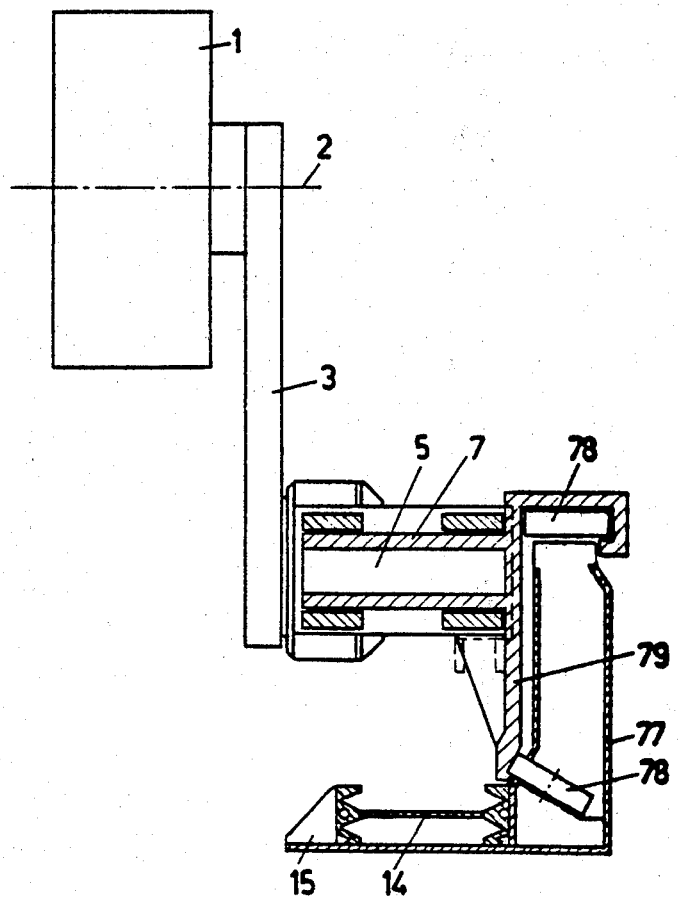
FIG. 10 is a diagrammatic side view similar to the one of FIG. 2 pertaining to a variation of the machine as shown in FIGS. 1 to 5.
Figure 11:
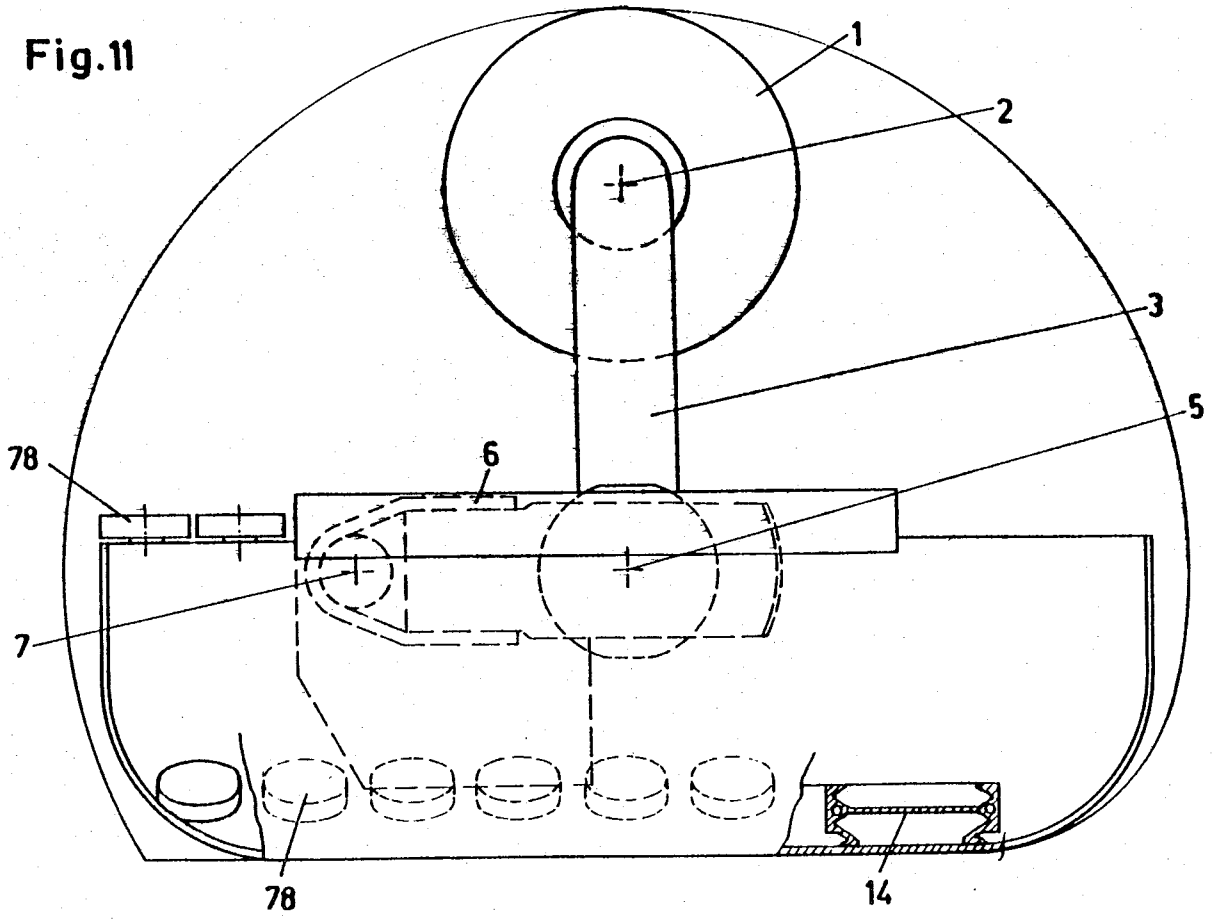
FIG. 11 is a diagrammatic front view of the machine as shown in FIG. 10.

The machine as shown in FIGS. 10 and 11 is a variation of the machine shown in FIGS. 1 to 5 and is mainly suitable for the application as shown in FIGS. 8 and 9, namely for digging galleries and tunnels when the working in the face is not to be performed with the same machine. The limitations as regards the dimensions are less stringent in this case, whereby the machine may be higher even in retracted condition.

In the embodiment as shown in FIGS. 10 and 11, the side plates 77 on the back side of the conveyor are made very strong. Said side plates bear at the top and bottom guide rollers 78 which guide and retain a carriage 79 extending mainly in a vertical direction.

As it appears from FIG. 10, said carriage 79 is engaged over the top guide rollers 78 and the carriage bears against the bottom guide rollers 78. Said carriage 79 is provided with an axis 7 projecting on the front side. About said axis 7 is hinged frame 6 which bears axis 5 about which hinges arm 3 which bears at the other end thereof the cutting drum 1.

The operation of the machine as shown in FIGS. 10 and 11 does not differ essentially from the operation of the machine shown in FIGS. 1 to 5, but in the present embodiment the carriage does not have to be in the shape of a frame, as said carriage 79 proper to the exception of axis 7, lies completely behind conveyor 14, in such a way that the cut material can fall without any obstacle on conveyor 14.

The invention is in no way limited to the above embodiments and within the scope of the invention, many changes can be brought thereto notably as regards the shape, the composition, the arrangement and the number of the components used.

For instance in the embodiment according to FIG. 1, the winch can be mounted on the right-hand side as well as on the left-hand side. In the embodiment according to FIGS. 1 to 5, the carriage does not have necessarily to be in the shape of a frame with four sides. The carriage can also be designed in U-shape, whereby then one side from the frameshaped structure is dispensed with. The center opening for the loading is of course retained. When the beam which connects the carriage guides on the back side can be made heavy enough, that beam connecting the slippers on the front side may be dispensed with in such a way that there is even less hampering for the loading of the cut material on the conveyor.

It is also possible to dispense with one of the L-shaped parts which form the connection between a guide on the back side and a slipper on the front side. In this case also the carriage is substantially U-shaped.

Such U-shaped structure results actually in a less stiff carriage but the other advantages of the machine remain and the loading of the cut products on the conveyor is less hampered.

We claim:

1. Machine for cutting rocks in underground works, comprised of:
   - a slide way,
   - a carriage on said slide way,
   - means to move the carriage on said slide way,
   - a machine frame hinged relative to said carriage about a first axis at right angle to the lengthwise direction along which extends the slide way,
   - means imparting to said machine frame a swinging movement about said first axis relative to the carriage,
   - an arm hinged relative to the machine frame about a second axis in parallel relationship with said first axis,
   - means imparting to said arm a swinging movement about the second axis relative to the machine frame,
   - a cutting drum mounted relative to said arm, which rotates about a drum axis in parallel relationship with said first axis and second axis, and
   - means to rotate said cutting drum about the drum axis, in which the sizes of the cutting drum, the arm, the machine frame and the carriage as well as the swinging motions imparted to the machine frame relative to the carriage and to the arm relative to the machine frame are so selected that the single cutting drum can be swung so far out at both ends of the slide way in the lengthwise direction thereof, that no single component extends further away in such a way that the cutting drum can cut free the machine at both ends of said slide way.

2. Machine as defined in claim 1, in which the radius of the cutting drum is shorter than the spacing between the drum axis and the second geometrical axis.

3. Machine as defined in claim 1, in which the spacing between the geometrical axes of the second axis and the cutting drum increased by the radius of the cutting drum is larger than the spacing between the geometrical axes of the first axis and the second axis.

4. Machine as defined in claim 1, in which said means for imparting a swinging motion about the second axis to said arm, can impart a movement over at least 360°.

5. Machine as defined in claim 1, in which said carriage bears with two slippers on the slide way on the side of the cutting drum, is engaged with two guides about part of said slide way on the side removed from said cutting drum, and encloses between said slippers and guides, an open space which leaves free a space for the machine frame.

6. Machine as defined in claim 5, in which the carriage is of frame shape with an opening wherein said machine frame is swingable up and down.

7. Machine as defined in claim 6, in which said carriage comprises a beam connecting both slippers on the side of the cutting drum, a beam connecting both guides on the side removed from the cutting drum, and two parts which each connect a slipper on the side of the cutting drum to a guide on the side removed from the cutting drum.

8. Machine as defined in claim 1, in which said carriage is provided with retractable supports which lie in extended position outside said slide way.

9. Machine as defined in claim 1, in which said carriage extends mainly in the height direction and the first axis extends essentially at right angle to said carriage.

10. Machine as defined in claim 1, in which the means to impart to said arm a swinging movement about the second axis relative to the machine frame, is comprised of a planetary gearing the planetary cage of which is connected to said arm, the crown gear is connected to the machine frame, and the sun wheel lies about the second axis and is driven by a motor mounted on the machine frame.

11. Machine as defined in claim 10, in which said sun wheel is hollow and the means to rotate said cutting drum about the drum axis comprises a motor which is mounted on the machine frame and is connected to the cutting drum through a mechanical transmission which comprises a shaft which runs through said sun wheel.

12. Machine as defined in claim 11, in which said latter shaft is hollow and through said hollow shaft runs a tube with at least one duct.

13. Machine as defined in claim 12, in which the duct is connected to a sprinkling water source and opens at the level of said cutting drum.

14. Machine as defined in claim 12, which further comprises a hydraulically-controlled load shield the hydraulic control lines of which run through said hollow shaft.

15. Machine as defined in claim 1, in which the means imparting to the machine frame a swinging movement relative to the carriage, is a hydraulic cylinder mounted on the side removed from the cutting drum, cylinder both parts of which are hingedly connected respectively, to the machine frame and to the carriage.

* * * * *